United States Patent [19]

Lazcano-Navarro et al.

[11] Patent Number: 5,043,137

[45] Date of Patent: Aug. 27, 1991

[54] METHOD AND DEVICE TO PRODUCE A COATING FROM METAL POWDER METALLURGICALLY BONDED TO A METALLIC PART

[75] Inventors: Arturo Lazcano-Navarro; Gregorio Vargas-Gutierrez; Andres Geronimo-Torres; Francisco M. Flores-Malacara, all of Coahuila, Mexico

[73] Assignee: Instituto Mexicano de Investigaciones Siderugrgicas, Coahuila, Mexico

[21] Appl. No.: 651,554

[22] Filed: Feb. 6, 1991

[51] Int. Cl.[5] ..... B22F 7/00

[52] U.S. Cl. ..... 419/8; 419/38; 419/48; 419/49; 419/58; 419/60; 419/68

[58] Field of Search ..... 419/8, 38, 48, 58, 60, 419/68, 49

[56] References Cited

U.S. PATENT DOCUMENTS 3,678,567 7/1972 Manilla et al. ..... 419/9
3,753,704 8/1973 Manilla et al. ..... 419/8
4,526,747 7/1985 Schimmel et al. ..... 419/8
4,627,958 12/1986 Hays ..... 419/8
4,980,126 12/1990 Johas ..... 419/8

*Primary Examiner*—Stephen J. Lechert, Jr.
*Attorney, Agent, or Firm*—Laurence R. Brown

[57] ABSTRACT

This invention relates to a method and a device to produce a coating from metal powder metallurgically bonded to a metallic part, said metal powder being compacted over the surface of said metallic part to form the coating using cold isostatic pressing, then coupling an open metallic container to the coating leaving a space between said open metallic container and said coating, completely filling the space between the metallic container and the coating with a ceramic material and sealing, so that the ceramic material exerts pressure due to the thermal expansion over the coating during the heating in a sintering furnace in order to get a metallurgical bond between the metallic part and the coating and simultaneously sintering the coating to achieve the desirable the desirable thickness and the required properties.

4 Claims, 1 Drawing Sheet

METHOD AND DEVICE TO PRODUCE A COATING FROM METAL POWDER METALLURGICALLY BONDED TO A METALLIC PART

BACKGROUND OF THE INVENTION

1. Field of the Invention

This invention relates to a method and a device to produce a coating from metal powder metallurgically bonded to a metallic part.

2. Description of the Art

Composite materials are parts that require a combination of mechanical properties that cannot be obtained by a single material. The common processes to obtain coated metallic part include: electroplating, welding, plasma spraying, brazing, chemical vapor deposition, physical vapor deposition, etc. Some of the coatings obtained by these processes have the disadvantage of only being able to have a thickness of a few thousandths of an inch or a few microns, others are not metallurgically bonded, and still others have composition restrictions, Hot isostatic pressing is a process where the metallic part is loaded into a metallic can and the remainder of the container is filled with powder of desired composition and sealing. During the hot isostatic pressing cycle, loose powder is compacted and bonded to the metallic part. An important drawback of the process isits high cost. Cold isostatic pressing of metal powder is a process not restricted by thickness, composition or geometry, but only with sintering it is impossible to obtain the metallurgical bond.

It is the purpose of this invention to obtain a coating from metal powder metallurgically bonded to a metallic part.

SUMMARY OF THE INVENTION

This invention relates to a method and a device to produce a coating from metal powder metallurgically bonded to a metallic part, said metal powder being compacted over the surface of said metallic part to form the coating using cold isostatic pressing, being work pressure range between 10000 psi and 100000 psi, then coupling an open metallic container to the coating leaving a space between said open metallic container and said coating, completely filling the space between the metallic container and the coating with a ceramic material and sealing, so that the ceramic material exerts pressure due to the thermal expansion over the coating during the heating cycle in a sintering furnace in order to get a metallurgical bond between the metallic part and the coating and simultaneously sintering the coating to achieve the desirable thickness and the required properties.

DESCRIPTION OF THE PREFERRED EMBODIMENT

Figure 1:
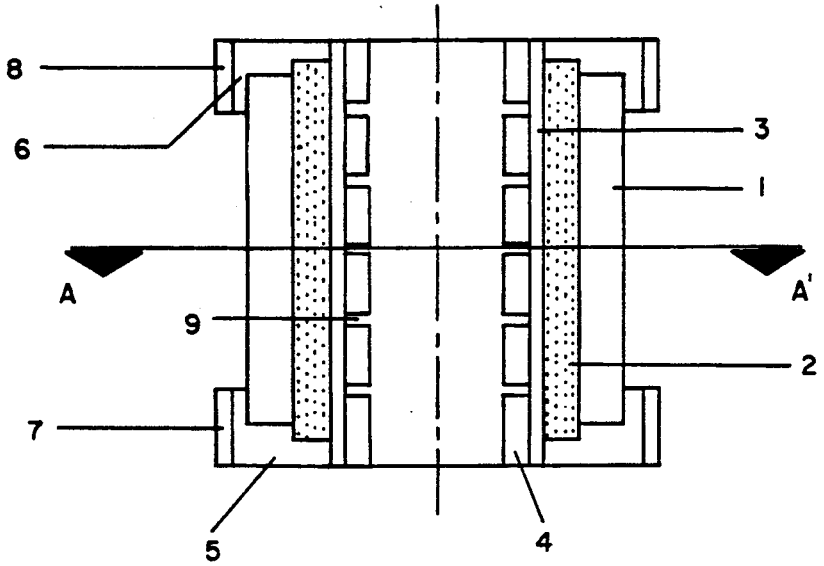
FIG. 1 is a longitudinal cross-sectional view of the required design for cold isostatic pressing of metal powder to the metallic part using the dilating wet bag tooling.
Figure 2:
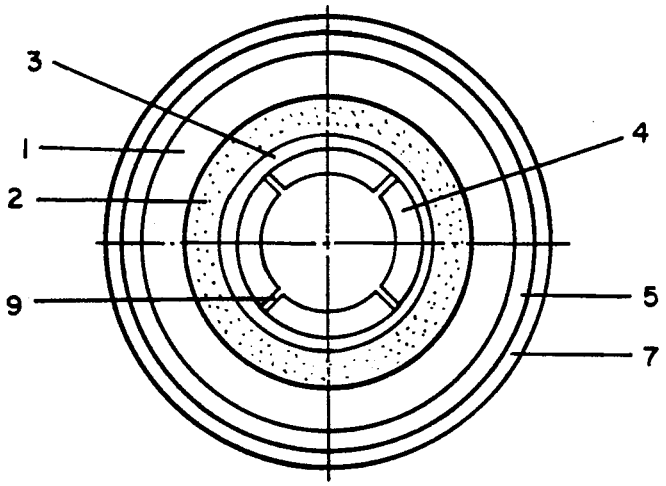
FIG. 2 is a transverse cross-sectional view taken along the line A—A' of FIG. 1.

Referring to FIG. 1, thereof, elastomer 3 is placed in the metallic part 1, said elastomer 3 placed over metallic support 4, provided with multiple holes 9 (shown in FIG. 1 and FIG. 2), elastomer 5 is placed in the lower of the metallic part 1 pressing over the lower of the elastomer 3, which presses over the lower of the metallic support 4. Metallic ring 7 is placed over the elastomer 5 to seal. The space between metallic part 1 and elastomer 3 is filled with metal powder 2. After filling said space, elastomer 6 is placed in the upper of the metallic part 1 pressing over the upper of the elastomer 3, which presses over the upper of the metallic support 4. Metallic ring 8 is placed over elastomer 6 to seal. This arrangement is placed in the cold isostatic press, where elastomer 3 dilates because of the pressure of fluid used in the press compacting metal powder 2 over metallic part 1, to form the internal coating, being the work pressure range between 10000 psi and 100000 psi. After compaction, metallic ring 7, metallic ring 8, elastomer 5, elastomer 6, elastomer 3, and metallic support 4 are removed and staying only the internal coating over metallic part 1.

Figure 3:
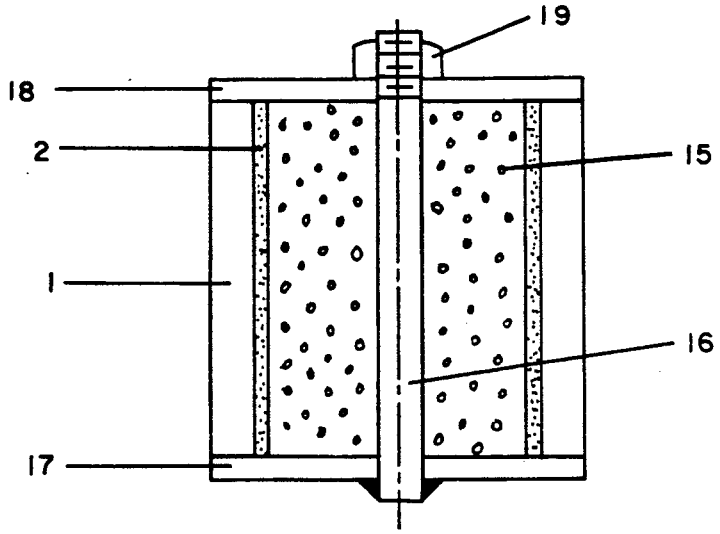
FIG. 3 is the required device to obtain the metallurgical bond between the internal coating from metal powder 2, which is previously compacted by cold isostatic pressing and said metallic part, due to the thermal expansion of the ceramic material 15, which exerts pressure over the internal coating during the heating cycle in a sintering furnace in vacuum or controlled atmosphere (hydrogen, inert gas or mixed gases).

To achieve the metallurgical bond during the heating cycle in a sintering furnace in vacuum or controlled atmosphere (hydrogen, inert gas or mixed gases) it is mandatory to exert pressure over the internal coating from metal powder 2 previously compacted, by means of placing metallic bar 16 screwed on upper part in the longitudinal axis of said internal coating and the lower part of the metallic bar 16 welded to metallic disk 17, being the outer diameter of the metallic disk 17 higher than the inner diameter of the lower of the metallic part 1. The space between the internal coating and the metallic bar 16 is filled with the ceramic material 15. Metallic disk 18 is placed in the upper of the metallic bar 16, being the outer diameter of t metallic disk 18 higher than the inner diameter of the upper of the metallic part 1, and nut 19 presses metallic disk 18 in order to compact the ceramic material 15 so that it completely fills the space between the internal coating from metal powder 2 and the metallic bar 16 (See FIG. 3). Here, the container is made up by the metallic bar 16, metallic disk 17, and metallic disk 18. The device is placed in the sintering furnace, and during the heating cycle in vacuum or controlled atmosphere (hydrogen, inert gas or mixed gases) the ceramic material 15 exerts pressure dure to the thermal expansion over the internal coating in order to get the metallurgical bond between the metallic part 1 and the internal coating. The sintering temperature is in the range between 5° C. and 20° C. below the melting temperature of the internal coating and the sintering time is between about 0.2 and about 4 hours to obtain the required properties and the thickness of the sintering internal coating. After the heat cycle, nut 19, metallic disk 18, metallic bar 16, metallic disk 17 and ceramic material 15 are removed, staying only the sintered internal coating metallurgically bonded to metallic part 1.

EXAMPLE

A metallic steel bushing is internally coated with bronze powder and a metallurgical bond is obtained under the following conditions: cold isostatic pressing of the bronze powder over the steel bushing between 20000 psi and 40000 psi, sintering in an inert gas furnace between 882° C. and 897° C. and 1 hour of sintering time, using ceramic material to exert pressure over compacted bronze powder during the heating cycle.

What is claimed as new and desired to be protected by letter patent is set forth in the appended claims:

1. A method to reproduce a coating from metal powder metallurgically bonded to a metallic part, said method comprising the steps of cold isostatic pressing of metal powder over the surface of the metallic part to form the coating, then coupling an adjacent metallic container to the coating leaving a space between said metallic container and said coating, completely filling the space between the container and the coating with a ceramic material, sealing the container, heating the ceramic material over a heating cycle so that the ceramic material exerts pressure due to thermal expansion over the coating during the heating cycle thereby to produce a metallurgical bond between said metallic part and said coating.

2. The method defined in claim 1, further comprising the steps of compacting the ceramic material before heating.

3. The method defined in claim 1 further comprising the steps of surrounding said powder with an elastomer, compacting the metal powder by a dilating wet bag method in the cold isostatic pressing step with said elastomer, and removing said elastomer.

4. The method of claim 1 further comprising the steps of cold pressing the powder at a pressure between 20,000 psi and 40,000 psi, and sintering the ceramic material in the heating cycle at a temperature between 882° C. and 897° C. for about one hour.

* * * * *